US007063409B2

(12) United States Patent
Koga

(10) Patent No.: US 7,063,409 B2
(45) **Date of Patent: *Jun. 20, 2006**

(54) INK JET PRINTER

(75) Inventor: Yuji Koga, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/849,146

(22) Filed: May 20, 2004

(65) Prior Publication Data

US 2004/0212665 A1 Oct. 28, 2004

Related U.S. Application Data

(63) Continuation of application No. 10/315,167, filed on Dec. 10, 2002, now Pat. No. 6,755,514.

(30) Foreign Application Priority Data

Dec. 10, 2001 (JP) ..... 2001-376405
Dec. 10, 2001 (JP) ..... 2001-376406

(51) Int. Cl.
*B41J 2/175* (2006.01)

(52) U.S. Cl. ..... 347/85

(58) Field of Classification Search ..... 347/49, 347/85, 86, 87; 138/111, 115, 118
See application file for complete search history.

(56) References Cited

U.S. PATENT DOCUMENTS 3,373,435 A * 3/1968 Strong ..... 346/140.1
4,475,116 A * 10/1984 Sicking et al. ..... 347/86
4,511,907 A * 4/1985 Fukuchi ..... 347/12
4,684,962 A * 8/1987 Hirosawa et al. ..... 347/85
5,025,270 A * 6/1991 Umezawa ..... 347/85
5,473,354 A * 12/1995 Arquilevich et al. ..... 347/85
5,486,854 A 1/1996 Uchida
5,936,740 A 8/1999 Fukazawa et al.
5,996,217 A 12/1999 Tokunaga et al.
6,068,370 A 5/2000 Miller et al.
6,264,322 B1 7/2001 Axtell et al.
6,755,514 B1 * 6/2004 Koga ..... 347/85

FOREIGN PATENT DOCUMENTS

| | | |
|---|---|---|
| EP | 0 826 504 A2 | 3/1998 |
| JP | 57-100086 | 6/1982 |
| JP | 9323430 | 12/1997 |
| JP | 10-226084 | 8/1998 |
| JP | 11-268288 | 10/1999 |
| JP | 11-286101 | 10/1999 |
| JP | 2001-171145 | 6/2001 |
| JP | 2001-260380 | 9/2001 |

* cited by examiner

*Primary Examiner*—Anh T. N. Vo
(74) *Attorney, Agent, or Firm*—Oliff & Berridge, PLC

(57) ABSTRACT

An ink jet printer includes an ink container supplying ink through a tube member to a separate print head to form an image. The ink jet printer also includes a guide rail to guide the print head, a transport roller to feed the recording medium, and a cover to prevent the tube member from contacting the roller. As the print head reciprocates in a width direction of a recording medium, the tube protruding from a surface of the print head on an end side in a moving direction thereof bends or flexes when the print head moves together with a carriage. The bending of the tube in the rearward direction is restricted by a tube band contacting the transport roller and cover. The cover and guide rail form a plane vertical to a platen at front faces of the cover and the guide. When the bending or movement of the tube is blocked or restricted by the vertical plane to a tube bending direction, the tube is not raised. Therefore, a resistance is not applied to the print head during the movement of the print head. Thus, the bending or movement of the tube can be restricted without providing a special device for the ink jet printer.

26 Claims, 9 Drawing Sheets

INK JET PRINTER

This is a Continuation of application Ser. No. 10/315,167 filed Dec. 10, 2002 now U.S. Pat. No. 6,755,514. The entire disclosure of the prior application is hereby incorporated by reference herein in its entirety.

BACKGROUND OF THE INVENTION

1. Field of Invention

The invention relates to an ink jet printer that ejects ink from a print head to form an image on a recording medium, and, more particularly, to a serial-type ink jet printer that forms the image by supplying the ink through a tube to the print head reciprocating in a width direction of the recording medium.

2. Description of Related Art

Some conventional ink jet printers are separately provided with an ink container that contains ink and a print head. The ink is supplied to the print head from the ink container through a tube. Such structure enables the print head to be reduced in size, as compared to a structure where the print head is integrally provided with the ink container. If a serial-type ink jet printer employs separate structures for the print head and the ink container, the size and weight of the print head is reduced and consequently loads to a carriage motor is reduced. Accordingly, the downsized carriage motor can be used.

SUMMARY OF THE INVENTION

When the ink is supplied to the print head from the ink container through the tube, as described above, the tube may be provided to the print head so as to protrude from a top surface of the print head (surface opposite to a platen), or so as to protrude from surfaces of the print head on each end side in a moving direction thereof The latter structure is desirable, especially when the ink jet printer needs to be low-profile and compact as a mobile printer.

In this case where the tube is protruded from a surface of the print head on an end side in the moving direction thereof, the tube bends as the print head moves. A roller that transports a recording medium to a direction (sub scanning direction) perpendicular to the moving direction of the print head (main scanning direction) may often be disposed near the platen, that is, near a moving area of the print head. The roller is preferably disposed near the print head to prevent the recording medium from floating or lifting.

With such a structure as described above, the flexing tube is likely to make contact with the roller. When the tube contacts the roller, the tube is caught on a frictional member (such as rubber and coating) provided on a surface of the roller, so that a resistance may be applied to the print head during its movement or the tube may be damaged by the roller rubbing the surface of the tube. Accordingly, the resistance to the movement of the print head causes a change in a moving speed of the print head, so that positions where ink is to be ejected cannot be precisely controlled. The tube caught on the roller might have damages that result in an ink leakage from the tube.

To prevent the roller and the tube from making contact with each other, the roller may be covered partially at least on the side near the tube. However, when the flexing tube makes contact with the cover, the tube is raised and may result in resistance to the movement of the print head. In addition, an encoder strip, as a position identification member, may be provided near the moving area of the print head along the moving direction of the print head, so that the range where the tube is allowed to bend may be restricted. If some special devices are provided to restrict the bending of the tube, the downsizing of the ink jet printer becomes difficult.

Accordingly, one aspect of the invention is to provide an ink jet printer that forms an image by supplying ink through a tube to a print head reciprocating in a width direction of a recording medium, wherein bending of the tube is restricted without providing a special device for the ink jet printer and without applying a significant resistance to the movement of the print head.

To achieve the aspect of the invention an ink jet printer according to the invention may include a print head that forms an image onto a recording medium by ejecting ink, an ink container that contains the ink supplied to the print head and is provided separately from the print head, a guide rail that guides the print head in a width direction of the recording medium, a print head moving device that reciprocates the print head along the guide rail, a tube member that protrudes from a surface of the print head on an end side in a moving direction thereof, connects the print head and the ink container over a full range of a print head moving area to supply the ink from the ink container to the print head, and has elasticity, a roller that feeds the recording medium in a direction perpendicular to the guide rail and is disposed near the guide rail, and a cover that covers the roller to prevent the tube member, that bends as the print head moves, from contacting the roller. The cover and the guide rail may be disposed along a plane substantially vertical to a direction that the tube member bends as the print head moves. The cover and the guide rail may be disposed with a distance therebetween that prevents the tube member from passing through the distance between the cover and the guide rail.

In the ink jet printer according to the invention, a face of each of the guide rails that guides the print head in the width direction of the recording medium and the cover that prevents the tube member from contacting the roller may be disposed on a plane substantially vertical to a direction that the tube member bends. In addition, the cover and the guide rail may be disposed with a distance therebetween that prevents the tube member from passing through the distance between the cover and the guide rail. The cover and the guide rail may constitute such a vertical plane that blocks the bending of the tube member.

According to the invention, the tube member may be prevented from bending beyond the guide rail and the cover, without providing special devices for the ink jet printer. Therefore, if the position identification member is provided on a side opposite to the print head with respect to the guide rail, the position identification member may be prevented from being contaminated as the tube member makes contact with the position identification member. Further, the guide rail and the cover may constitute the plane substantially vertical to the direction in which the tube member bends. Therefore, when the bending or the movement of the tube member is blocked by the guide rail and the cover forming the plane vertical to the direction that the tube member bends, the tube member may not be raised. When the bend in the tube member dynamically flexes as the print head reciprocates along the guide rail, a volume trajectory delineated by the dynamically flexing bend is substantially contained within a volume of a trajectory delineated by the print head while the print head reciprocates. Consequently, resistance to the movement of the print head may be minimized. Therefore, ink ejection positions may be precisely controlled.

Further, the tube member that supplies the ink from the ink container to the print head may be set with a flat cable that supplies current to the print head, and may be moved together with the flat cable. The tube member and the flat cable may be tied in a bundle by a tying member of a coupling member (tube band). The distance between the cover and the guide rail may be shorter than a length of the tying member, so that the tube member or the flat cable may not pass through the distance between the cover and the guide rail.

With the above-described structure, the distance between the cover and the guide rail may be narrower than the length of the tying member that holds the tube member and the flat cable in a bundle. Therefore, as described above, the tube member may be prevented from bending beyond the guide rail and the cover. The bending of the tube member may be restricted by making the tying member contact with the cover and the guide rail. Therefore, the distance between the cover and the guide rail, and a dimension of a tube constituting the tube member, as well as a width of the flat cable may be freely set, increasing design flexibility.

Preferably, a plurality of the tubes constituting the tube member may be divided into two tube groups. Each tube group may be protruded from one surface of the print head on an end side in a moving direction of the print head. The flat cable that supplies the current to the print head may be set with each tube group protruding from one surface of the print head.

The tubes supplying the ink therethrough from the ink container provided separately from the print head may be protruded from the surface of the print head on both end sides in the moving direction of the print head, and may be set with the flat cables that supply the current to the print head. Thus, widths of the tube member and the flat cable may be reduced to half, so that demands for a mobile printer, such as compactness and thinness may be satisfied.

The flat cables may be separated into two, and the separated flat cables may be disposed away from each other. Therefore, crosstalk between the separated flat cables does not occur. In addition, patterns divided into two may be provided for each of the flat cables, so that occurrences of crosstalk may be reduced. Further, each of the flat cables may be set with the tubes and the movement of the flat cables may be stabilized.

BRIEF DESCRIPTION OF THE DRAWINGS

An embodiment of the invention will be described in detail with reference to the following figures wherein.

DETAILED DESCRIPTION OF PREFERRED EMBODIMENTS

Figure 1:
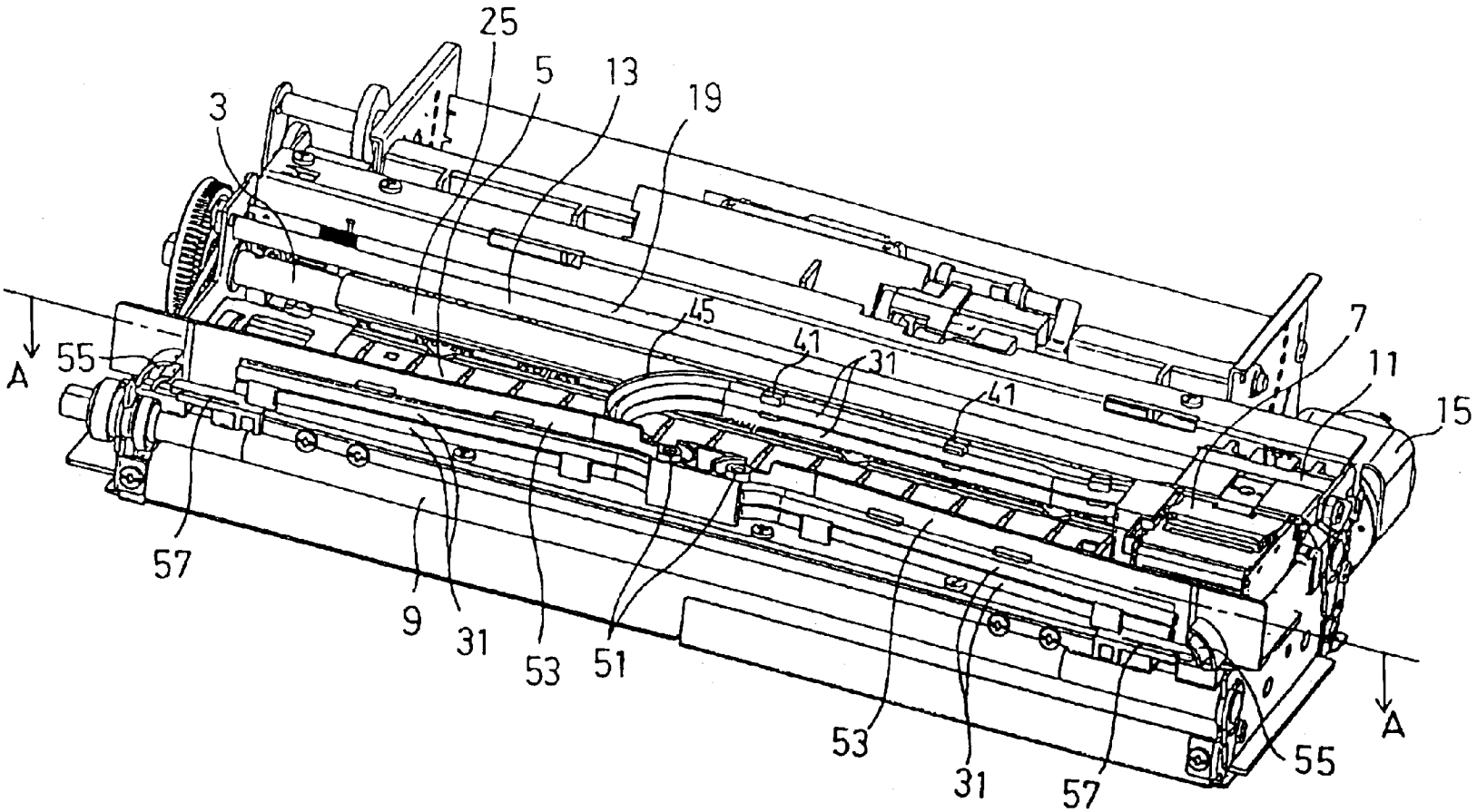
FIG. 1 is a perspective view showing an internal structure of an ink jet printer according to an embodiment of the invention, from a paper discharging side.
Figure 2:
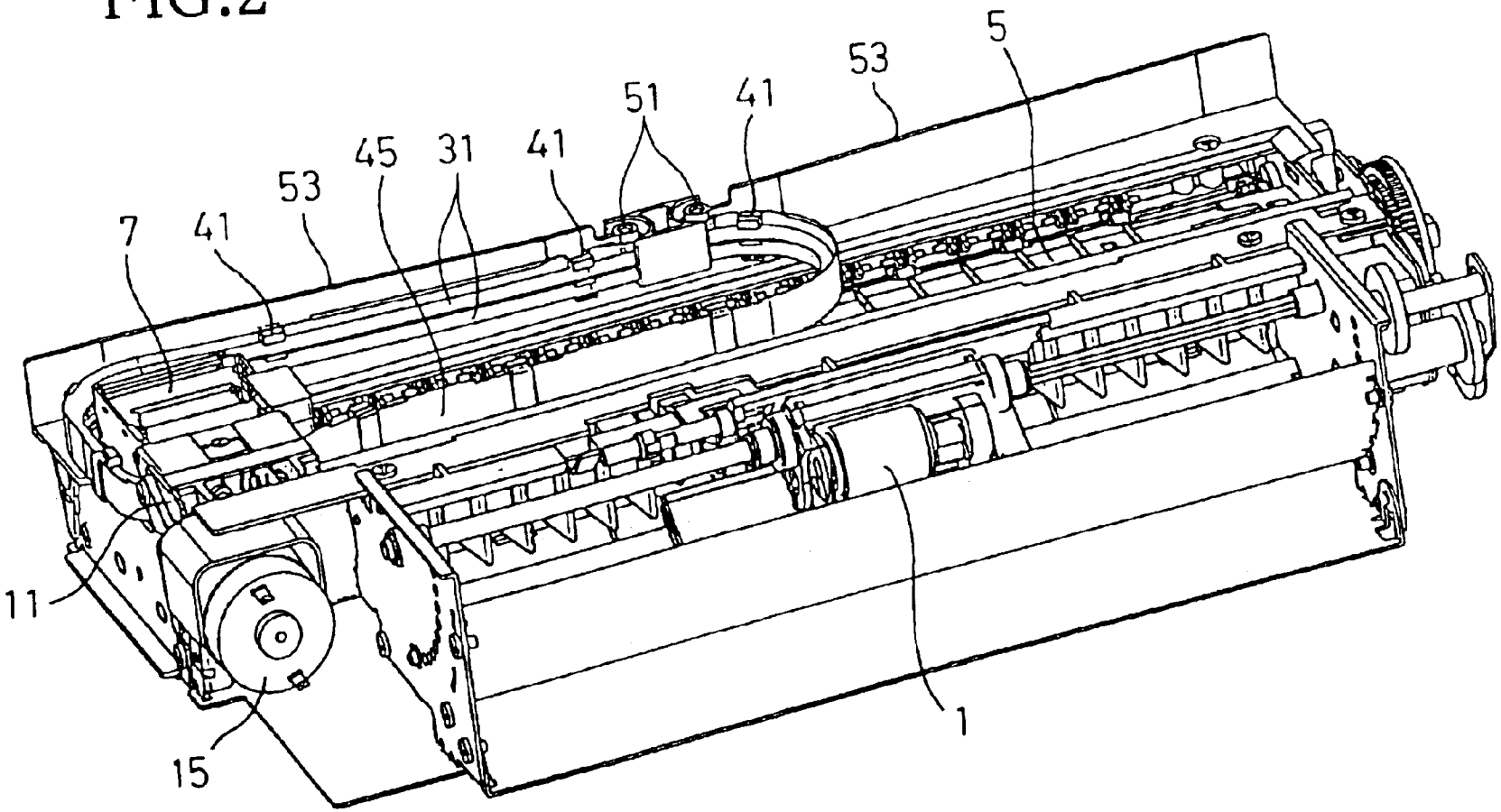
FIG. 2 is a perspective view showing an internal structure of the ink jet printer from a paper feeding side.

An ink jet printer according to an embodiment of the invention will be described with reference to the accompanying drawings. FIG. 1 is a perspective view showing an internal structure of the ink jet printer from a sheet discharging side, that is, from a downstream side in a sheet feeding direction (hereinafter referred to as the front side). FIG. 2 is a perspective view showing the internal structure of the ink jet printer from a sheet feeding side, that is, from an upstream side in the sheet feeding direction (hereinafter referred to as the rear side). As shown in FIG. 2, the ink jet printer is provided with a feed roller 1 at a rear portion thereof The feed roller 1 separates recording sheets (recording media) stacked on a sheet feed tray (not shown), one by one, and feeds the separated recording sheet in the sheet feeding direction. The recording sheet fed by the feed roller 1 is conveyed to a platen 5 by a transport roller 3 shown in FIG. 1. An image is formed with a print head 7 onto the recording sheet. Thereafter, the sheet having an image formed thereon is fed by a discharge roller 9 and discharged on to a discharge tray (not shown).

Figure 3:
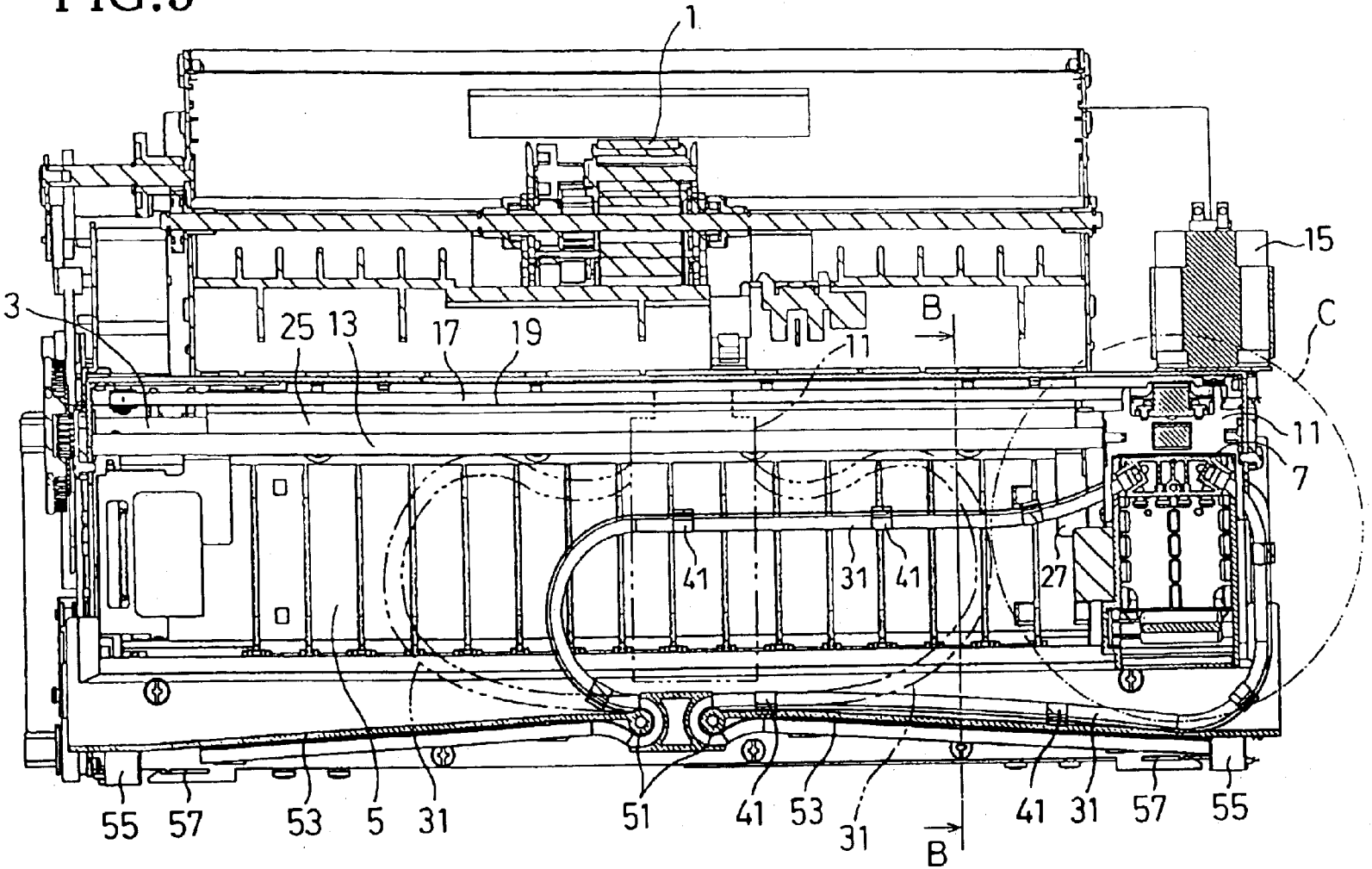
FIG. 3 is a cross sectional view of the ink jet printer taken along the line A—A of FIG. 1.
Figure 4:
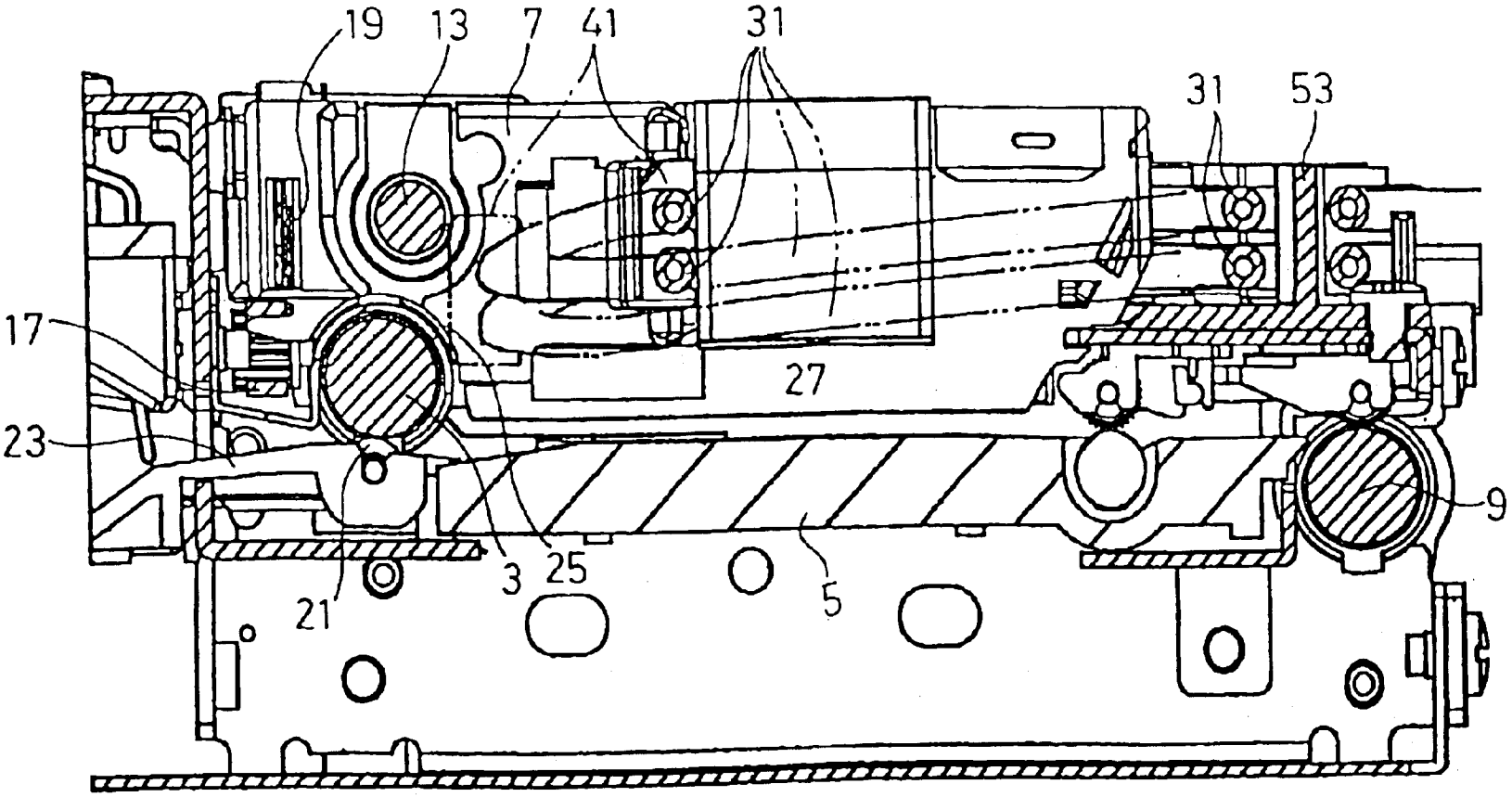
FIG. 4 is a cross sectional view of the ink jet printer taken along the line B—B of FIG. 3.

As shown in FIGS. 3 and 4, the print head 7 is mounted on a carriage 11. The carriage 11 is guided by a guide rail 13 so as to move across the recording sheet in a sheet width direction (in a main scanning direction). The carriage 11 is connected to an endless belt 17 driven by a carriage motor 15. The carriage 11 moves over the platen 5 across the recording sheet in the main scanning direction, according to the rotations of the carriage motor 15. An encoder strip 19 is provided on the rear side of the guide rail 13. The encoder strip 19 extends in the sheet width direction. In cooperation with an optical sensor (not shown) provided on the carriage 11, the encoder strip 19 constitutes a conventional linear encoder.

The print head 7 according to the embodiment is for ejecting color ink and is structured so as to eject four colors of ink, that is, yellow, magenta, cyan, and black ink. The print head 7 is provided with four drive portions and nozzle portions (not shown), in association with four colors of ink. The nozzle portion for each color ink is provided along the main scanning direction in the order of yellow, magenta, cyan, and black. The nozzle portion includes nozzles that are open downwardly toward the platen 5. The nozzles for each color ink are arrayed in a row so as to extend in the sheet feeding direction. Four tube members 31 are connected to the print head 7. Each color ink associated with one of the drive portions is supplied from an ink cartridge as an ink container 100, through one of the tube members 31. The tube members 31 will be described in detail.

Figure 9:
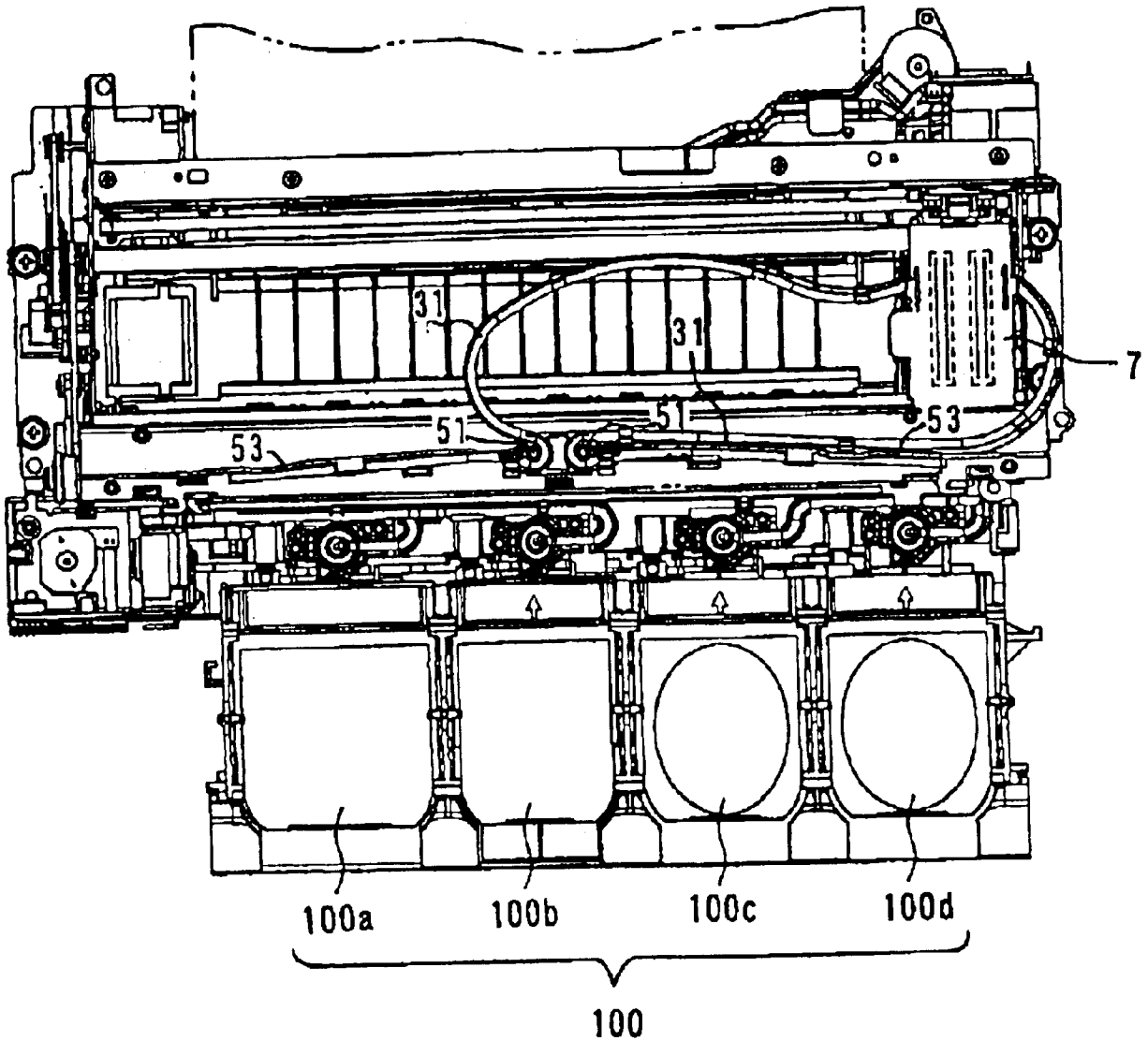
FIG. 9 is a top view of the ink jet printer in FIG. 1 including an ink container.

FIG. 9 shows an ink container (ink cartridge) 100 that includes four ink cartridges 100*a*–100*d* that contain black, cyan, magenta, and yellow ink, respectively. The ink container 100 is connected to the print head 7 through the tube members 31.

As shown in FIG. 4, disposed below the transport roller 3 is a roller 21 that presses the recording sheet against the transport roller 3. The roller 21 is urged upwardly by a spring (not shown) together with a roller holder 23. Provided along an upper portion of the transport roller 3 is a thin-metal cover 25 that prevents the transport roller 3 from contacting the tube members 31.

As shown in FIG. 4, a front face of the cover 25 (right-side face in FIG. 4) and a front face of the guide rail 13 (right-side face in FIG. 4) are provided on a plane vertical to the platen 5. A paper plate 27 that presses the recording sheet against the platen 5 is provided above the platen 5.

Figure 5:
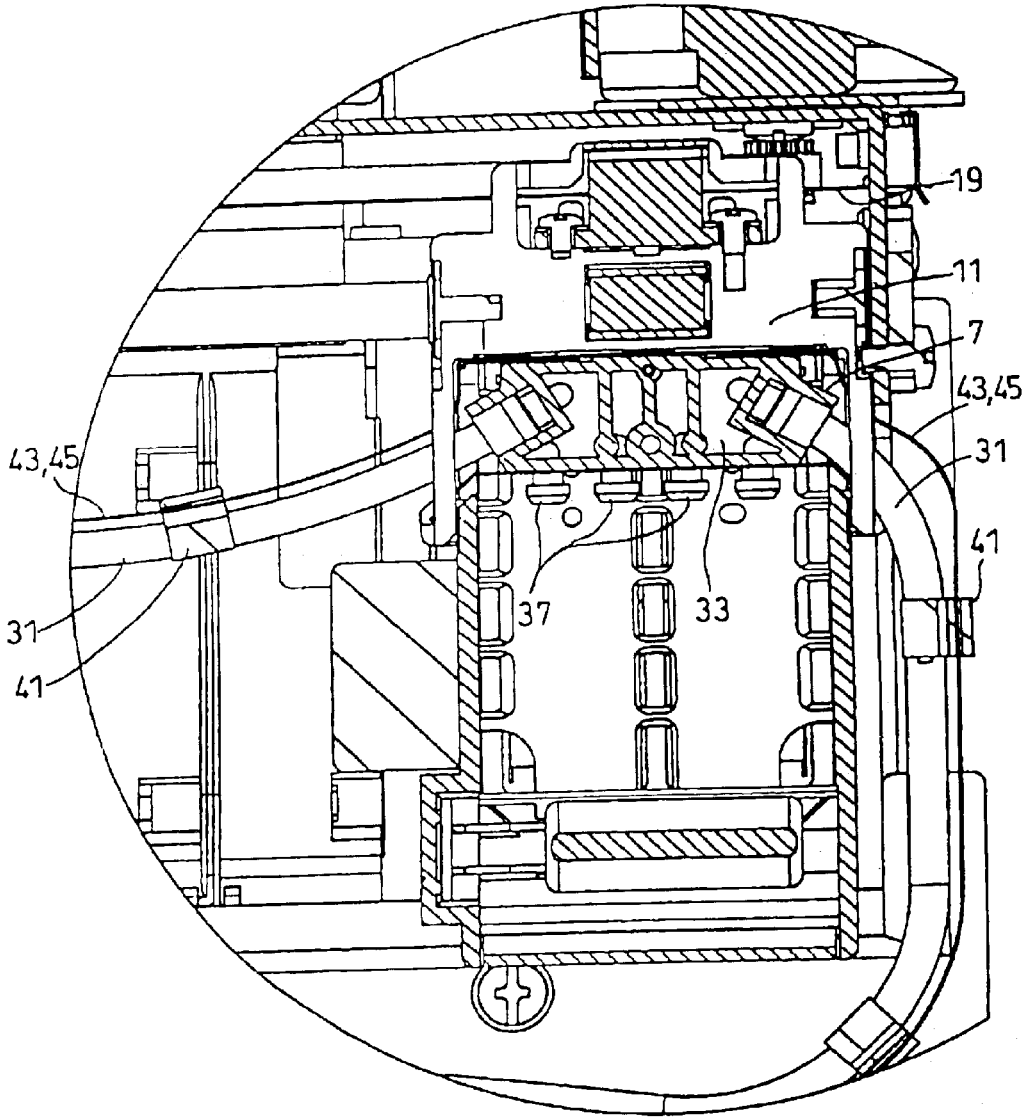
FIG. 5 is an enlarged view of the area enclosed in a circle C in FIG. 3.

As shown in FIG. 5, the tube members 31 that supply ink to the print head 7 protrude from surfaces of the print head 7 on end sides in a moving direction of the print head 7. The tube members 31 are inclined or angled toward the front side, that is, toward a supporting portion 51 (described below) at approximately 30 degrees with respect to the moving direction of the print head 7. The tube members 31 protruding from one side surface of the print head 7 are for supplying, for example, a magenta and yellow ink to the print head 7. The two tube members 31 for magenta and yellow ink are vertically aligned. The tube members 31 protruding on the other side surface of the print head 7 are for supplying, for example, cyan and black ink to the print head 7. Similarly, the two tube members 31 for cyan and black ink are vertically aligned. These tube members 31 are connected to the print head 7 through a manifold 33, which will be described below.

Figure 6B:
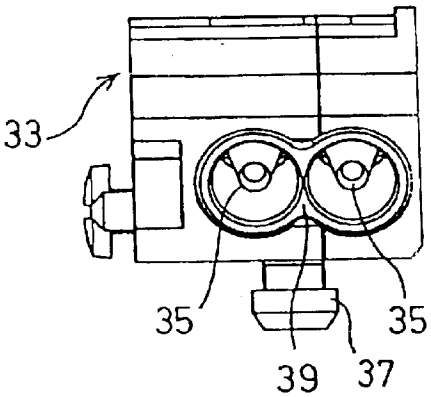
FIG. 6B is a side view of the manifold of the ink jet printer.
Figure 6A:
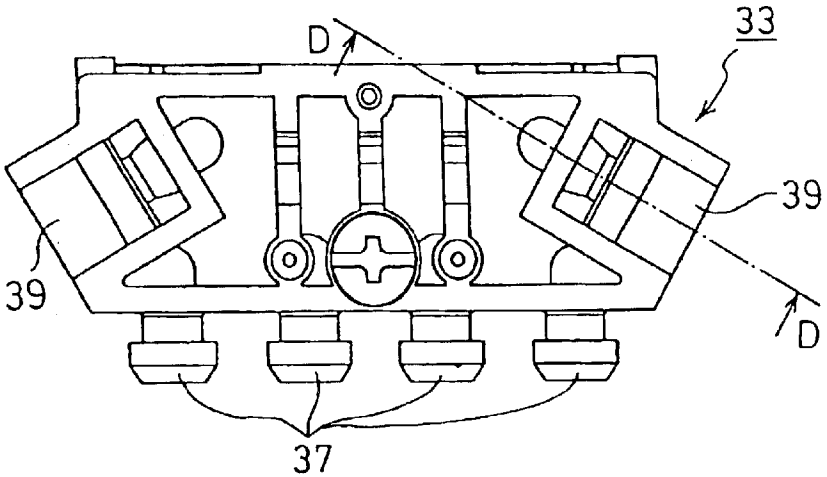
FIG. 6A is a plan view of a manifold of the ink jet printer.
Figure 6C:
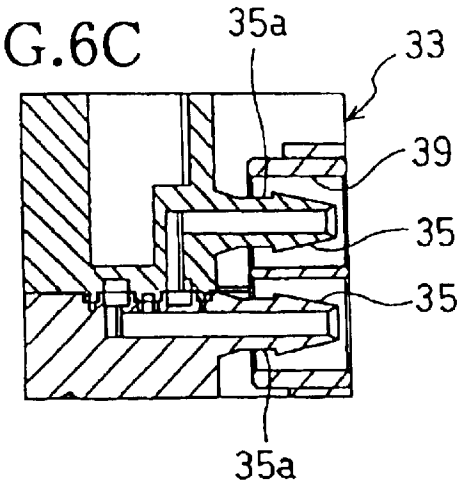
FIG. 6C is a cross sectional view of the manifold of the ink jet printer taken along the line D—D of FIG. 6B.

As shown in FIGS. 6A to 6C, the manifold 33 includes valves 35 extending along the protruding direction of the tube members 31. Each of the valves 35 includes a conical portion and a pipe portion 35*a* connected to the conical portion. The tube member 31 is inserted over an end of the conical portion of the valve 35 with a smaller diameter. The other end of the conical portion is larger in diameter than the pipe portion 35*a*. The ink supplied to the manifold 33 through the valve 35 is then supplied to the nozzles of the print head 7, through a supply port 37 provided for each color. A substantially "8"-shaped holder 39 having two hollow parts is disposed such that each hollow part of the holder 39 is fixedly inserted over the valve 35. The holder 39 is formed of a material harder than the tube member 31, because the holder 39 needs to press the tube member 31 against the valve 35. After the tube member 31 is inserted over the valve 35, the holder 39 is pushed into place. In the manifold 33 structured as described above, an outer surface of the tube member 31 is pressed by the holder 39 and an inner surface of the tube member 31 is pressed by the valve 35, so that the tube member 31 can be fixedly secured.

Figure 7:
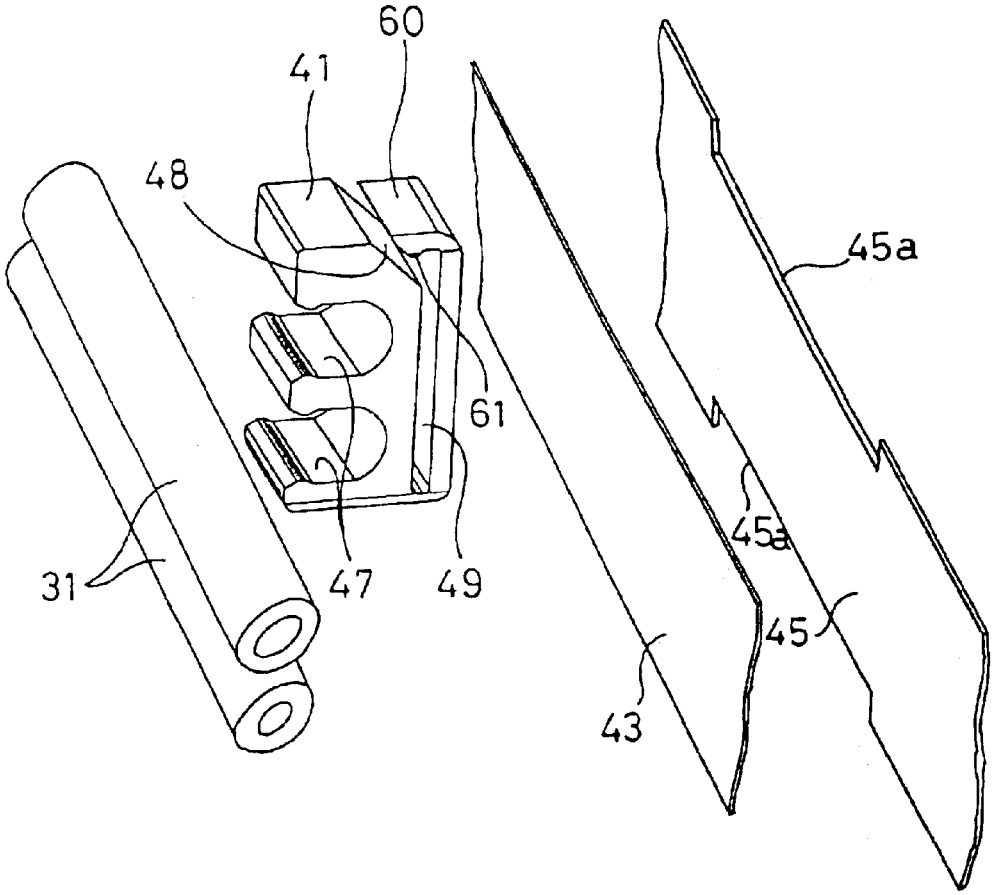
FIG. 7 is an exploded view showing a tube band, tube members, a flexible printed circuit board (FPC), and a FPC protective film.

The two tube members 31 protruding from each side surface of the print head 7 are tied in a bundle together with a flexible printed circuit board (FPC) 43 (or flat flexible cable) and a FPC protective film (hereinafter just referred to as "the protective film") 45 at some positions by a tube band 41 such as that shown in FIG. 7.

The tube band 41 is formed of elastic material, such as rubber and synthetic resin material having elasticity. As shown in FIG. 7, the tube band 41 has two openings 47 and a groove 49. Each opening 47 has flat portions, as a tube slip stopper, to securely hold the tube member 31 in the opening 47. The groove 49 has a stopper 60 that prevents the FPC 43 and the protective film 45 from coming out of the groove 49. The FPC 43 and the protective film 45 are loosely fitted into the groove 49 so as to allow the FPC 43 and the protective film 45 to move in the longitudinal direction thereof. The FPC 43 is positioned between the protective film 45 and the tube members 31 and protected by the protective film 45. The protective film 45 has substantially rectangular slits 45*a* on edges where the tube band 41 is disposed. The protective film 45 is supported in the tube band 41 so as to be able to move in the longitudinal direction thereof within a range of the length of the slits 45*a*.

A slope 48 is formed opposite to the stopper 60 of the tube band 41. A protrusion 61 is formed at an end of the stopper 60. The length of the groove 49 is longer than the width of the FPC 43 or the width of the protective film 45 where the slits 45*a* are formed, and shorter than the width of the protective film 45 where the slits 45*a* are not formed. The FPC 43 and the protective film 45 are inserted into the groove 49 in a bent state while being guided by the slope 48. The bent state of the FPC 43 and the protective film 45 is cleared as the width of the FPC 43 and the protective film 45 where the slits 45*a* are formed, completely fit in the groove 49. (A structure such that the protrusion 61 of the tube band 41 is temporarily moved or pulled against the elasticity of the tube band 41 to insert the FPC 43 and the protective film 45 into the groove 49, may be employed.) The FPC 43 and the protective film 45 completely inserted into the groove 49 as the bent state has been cleared, are prevented from moving toward the slope 48, due to the stopper 60 and the protrusion 61. Therefore, the FPC 43 and the protective film 45 do not come out of the groove 49.

Application or provision of too many tube bands 41 to the tube members 31 is not desirable since too many tube bands 41 prevent a smooth flexion of the tube members 31. In addition, it is undesirable that the tube band 41 be provided on the tube members 31 at a position where the tube band 41 contacts tube guides 53 (described blow), the guide rail 13, or the cover 25 to prevent noises and adverse effects on the tube members 31, as will be described below, that are caused by the contact between the tube band 41 and the tube guides 53, the guide rail 13, or the cover 25. However, the tube members 31, the FPC 43, and the protective film 45 are desirably tied by the tube band 41 at three portions, that is, near a connecting portion where the tube members 31 are connected to the print head 7, near the supporting portion 51, and at a substantially central portion between the supporting portion 51 and the print head 7, because distortion or misalignment of the tube members 31 relative to the FPC 43 and the protective film 45 tends to become large at these three portions.

Figure 8:
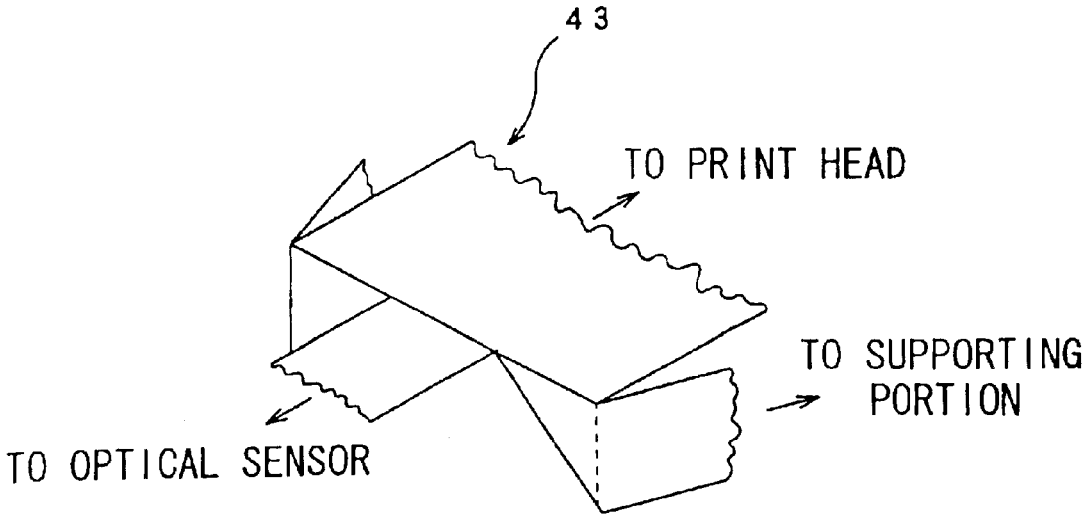
FIG. 8 is a perspective view of the FPC showing folding manner thereof

As shown in FIG. 5, the FPC 43 and the protective film 45 are guided to the rear end of the print head 7. Parts of the FPC 43 are folded at the rear end of the print head 7 and guided to the print head 7, the above-described optical sensor, or the supporting portions 51, as shown in FIG. 8. The protective film 45 is guided along the rear end of the print head 7 to the supporting portions 51 so as to extend from one side of the print head 7 to the other side thereof. More specifically, the FPC 43 includes drive signal lines to the four drive portions of the print head 7 and an output line to the optical sensor and is separated into three parts. A part of the FPC 43 positioned on the left side among the three parts of the FPC 43, is for example, the drive signal lines to the drive portions for the yellow and magenta ink. Another part of the FPC 43 positioned at the center is the output line to the optical sensor. The other part of the FPC 43 positioned on the right side is the drive signal lines to the drive portions for the cyan and black ink.

As shown in FIGS. 1 to 3, two supporting portions 51 formed into generally a cylindrical shape are provided in front of the platen 5 at substantially central portions of a moving area of the print head 7. The plate-like tube guides 53 that prevent the tube members 31 from protruding far forward are provided on one side of each supporting portion 51, so as to extend in an opposite direction to each other along the main scanning direction. The tube guide 53 is provided such that a rear surface thereof is positioned gradually forwarder from the supporting portion 51. As described above, the tube members 31, the FPC 43, and the protective film 45 protruding from one surface of the print head 7 facing the moving direction of the carriage 11, are tied in a bundle by the tube bands 41 at some positions. Each bundle of two tube members 31, the FPC 43, and the protective film 45 are guided to the supporting portion 51. Each bundle is then folded at the supporting portion 51 and secured along the front side of the tube guide 53. One bundle is guided to the right side from the supporting portion 51 and the other bundle is guided to the left side from the supporting portion 51. The tube members 31 in each bundle are guided through one of right and left guide pieces 55 to ink cartridges of the ink containers 100 provided below the platen 5. The FPC 43 is guided to a control circuit (not shown) provided below the platen 5, through a guide groove 57.

A pad or sponge, as a cushioning member, is provided on a surface of the tube guide 53 where a bundle of the tube members 31, the FPC 43, and the protective film 45 tied by the tube band 41 contacts. Thus, noises caused by the contact between the bundle and the tube guides 53, especially caused by the contact between the tube band 41 and the tube guide 53 can be reduced. In addition, deformation of the pad or sponge when loads are applied, can reduce a shock to the tube members 31. Therefore, durability of the tube members 31 can be increased. Further, a shock to the ink in the tube members 31 can be reduced, leading to proper ink ejection.

In the ink jet printer according to the embodiment, as the print head 7 is moved along with the carriage 11, the tube members 31 flex as shown by dotted lines in FIG. 3. The flexion of the tube members 31 in the forward direction is restricted by the rear surface of the tube guides 53, as described above. The flexion of the tube members 31 in the rearward direction is restricted by the protective film 45 or the tube band 41 making contact with the guide rail 13 and the cover 25.

As shown in FIG. 4, a front face of the cover 25 (right-side face in FIG. 4) and a front face of the guide rail 13 (right-side face in FIG. 4) are provided on a plane substantially vertical to the platen 5 with the distance between the cover 25 and the guide rail 13 narrower than the width of the protective film 45. With this structure, the cover 25 and the guide rail 13 form such a vertical plane that blocks or restricts the bending or movement of a bundle of the tube members 31, the FPC 43, and the protective film 45 tied by the tube band 41.

More specifically, the transport roller 3 and the guide rail 13 are disposed such that axes of the transport roller 3 and the guide rail 13 are not vertically aligned but slightly shifted in the sheet feeding direction, as shown in FIG. 4. The front face of the cover 25 covering the transport roller 3 and the front face of the guide rail 13 are disposed along a plane substantially vertical to the platen 5 at a position in the sheet feeding direction. Further, the distance between the cover 25 and the guide rail 13 is narrower than the width of the protective film 45 or the tube band 41.

With the above-described structure, the tube members 31 are prevented from bending beyond the guide rail 13 and the cover 25, without providing special devices for the ink jet printer. Therefore, the encoder strip 19 is prevented from being contaminated by the tube members 31 contacting the encoder strip 19. Further, the guide rail 13 and the cover 25 constitute the plane vertical to the direction in which the tube members 31 bend. When the bending or movement of the tube members 31 is blocked or restricted by the guide rail 13 and the cover 25 constituting the vertical plane to the tube bending direction, the tube members 31 are not raised and resistance to the movement of the print head 7 can be minimized. Therefore, ink ejection positions can be precisely controlled.

In addition, the distance between the cover 25 provided on the transport roller 3 and the guide rail 13 is set to such a short distance that the protective film 45 or the tube band 41 do not pass through. Thus, the thickness or height of the ink jet printer can be reduced.

As described above, in the ink jet printer according to the embodiment, the tube members 31 protrude from the surfaces of the print head 7 facing the direction (main scanning direction) of the print head 7, at an inclination angle of approximately 30 degrees with respect to the main scanning direction, toward the supporting portions 51. This angle setting is made based on the results of simulations and experiments performed to improve the endurance of the tube members 31. The inclination angle of the tube members 31 with arespect to the main scanning direction of the print head 7 is set to 15 to 45 degrees, and preferably 25 to 35 degrees. The inclination angle setting may vary according to the materials and the diameters of the tube members 31, as well as the space that the tube members 31 are allowed to bend or flex (bendable space). In view of the endurance of the tube members 31 with respect to bending, the optimum inclination angle of the tube members 31 is 30 degrees, when the tube members 31 having about a 3 mm outside diameter is formed of polyethylene-base material, and the length from the valve 35 to the tube guide 53 (bendable space) is about 60 mm.

As the inclination angle of the tube members 31 is set to an optimum angle, the resistance to the movement of the print head 7 can be restrained when the print head 7 is in a position shown by solid lines in FIG. 3 where the tube members 31 are pulled toward the supporting portion 51. Further, when the print head 7 is in a position shown by dotted lines in FIG. 3 where the tube members 31 bend between the supporting portions 51 and the print head 7, the tube members 31 can bend flexibly toward the supporting portions 51. Therefore, the resistance applied to the print head 7 by the tube members 31 during the movement of the print head 7 can be restricted.

When the print head 7 is moved to an end of the scanning area, as shown by the solid line in FIG. 3, the right-side tube members 31 in FIG. 3 flexibly bend toward the supporting portion 51 while ensuring areas of ink flow passages of the tube members 31, so that ink can be favorably supplied. Thus, a housing or a case of the ink jet printer can be reduced in size in the direction of a width of the recording sheet.

As described above, the bending of the tube members 31 in the forward and rearward directions is restricted by contacting the rear surfaces of the tube guides 53 and by contacting the guide rail 13 and the cover 25, respectively. The rear surfaces of the tube guides 53 are positioned forwarder as the end thereof is farther from the supporting portions 51, so that an area that the tube members 31 are allowed to flex are extended toward the front side and the tube members 31 can bend more flexibly along the rear surfaces of the tube guides 53. As the tube members 31 bend flexibly along the rear surfaces of the tube guides 53, the resistance applied to the print head 7 during the movement thereof can be reduced.

In addition, with the structures of the tube guides 53 slanting forwardly and the tube members 31 protruding at the inclination angle, the tube members 31 tend to flex or curve in the forward side (downstream side in the sheet feeding direction) toward the tube guides 53. Accordingly, the tube members 31 become less likely to contact the guide rail 13, the transport roller 3, or the cover 25 provided on the transport roller 3. Noises attributable to the guide rail 13 and the tube members 31 are thus prevented. Unlike the tube guides 53, the cushioning member such as the pad or sponge cannot be provided on the guide rail 13. Therefore, the contact between the guide rail 13 and the tube members 31 needs to be prevented as much as possible, to reduce the noises attributable to the guide rail 13 and the tube members 31.

According to the embodiment of the invention, the supporting portions 51 are provided at the substantially central portion of the moving area of the print head 7, so that the length of the tube members 31 connecting between the print head 7 and the supporting portion 51 can be minimized. Because the length of the tube members 31 can be reduced, the amount of bending of the tube members 31 can also be reduced. Accordingly, the resistance to the movement of the print head 7 can be reduced.

In the above-described embodiment, the tube members 31 are tied in a bundle together with the FPC 43 and the protective film 45 by the tube band 41. The FPC 43 and the protective film 45 in a bundle are movably held by the tube band 41 in the longitudinal direction of the FPC 43 and the protective film 45. Therefore, even when curvature of the tube members 31 at the curved portion is different from that of the FPC 43 and the protective film 45, the tube members 31 are not twisted or unfavorably bent. Accordingly, the resistance to movement of the print head 7 can be restricted. The range of the movement of the protective film 45 relative to the tube band 41 is restricted by the slits 45*a*. When the carriage 11 moves to one side in the main scanning direction, the FPC 43 and the protective film 45 smoothly move relative to the tube band 41 in the longitudinal direction thereof along with the movement of the carriage 11. When the carriage 11 moves back to the opposite side in the main scanning direction, the FPC 43 and the protective film 45 readily moves back along with the movement of the carriage 11.

The tube band 41 fixedly secures the tube members 31 into the openings 47 so as to prevent the tube members 31 from moving. Therefore, twists in the tube members 31 can be prevented. For example, twists in the tube members 31 may be prevented if the tube members 31 are fixed into the openings 47 in the following manner. First, the tube members 31 are secured parallel to each other using a jig. The tube band 41 is then fit over the tube members 31. Thus, the tube members 31 are prevented from being twisted and the resistance to movement of the print head 7 can be restricted. The FPC 43 and the protective film 45 can be assembled at a later process, as the FPC 43 and the protective film 45 can be readily inserted from above into the groove 49.

The protective film 45 is disposed with the width direction thereof vertical to the platen 5. Therefore, the bending of the tube members 31 in the downward direction toward the recording sheet can be prevented. Therefore, smudges caused by the tube members 31 making contact with the recording sheet can be prevented. By restricting the bending of the tube members 31, the resistance to movement of the print head 7 applied by the tube members 31 can be reduced. Therefore, the loads applied to the carriage motor 15 can be reduced. Consequently, ink ejecting positions can be precisely controlled, which leads to precise image formation.

The FPC 43 is set together with two tube members 31 protruding from the surface of the print head 7 on each end side in the moving direction thereof. As described above, the FPC 43 includes the signal lines for transmitting drive signals to the print head 7 (the drive signal lines to the drive portions of the print head 7) and for transmitting signals from the unillustrated optical sensor (output line to the optical sensor). The FPC 43 is divided into three parts, one part is for the output line to the optical sensor, and two parts are for the drive signal lines to the drive portions of the print head 7. The drive signal lines are equally divided into two parts of the FPC 43 in the above-described embodiment. The two parts of the FPC 43 are disposed away from each other. Therefore, crosstalk can be prevented because the parts of the FPC 43 do not overlap each other. According to the embodiment, the total number of the tube members 31 is four in order to supply four colors of ink. Combinations with respect to the colors of ink between the tube members 31 and the drive signal lines to the drive portions of the print head 7 can be made freely. However, it is desirable that the tube members 31 be set with the part of the FPC 43 that includes the drive signal lines to the drive portions associated with the same ink colors as the colors of ink that the tube members 31 supply. Such arrangement of the tube members 31 and the FPC 43 will be beneficial when determining causes of problems. Crosstalk that is caused by overlapping FPCs 43 does not occur according to the embodiment, because two parts of the FPC 43 are provided so as not to overlap each other. Further, the number of the drive signal lines or patters that are provided in the FPC 43 is equally divided into two. Thus, occurrences of crosstalk between the drive signal lines or patterns in the FPC 43 can be reduced. In addition, one part of the FPC 43 is set with the two tube members 31, by way of the tube band 41, in a bundle. The FPC 43 can stably move with the stabilized tube members 31.

According to the embodiment, crosstalk can be prevented without increasing the size of the ink jet printer. More specifically, a cross sectional area of the FPC 43 is maintained small, ensuring the flexibility of the FPC 43. In addition, a large-sized capacitor does not have to be provided in the ink jet printer to prevent crosstalk. Further, as the behavior or movement of the FPC 43 is stabilized, the endurance of the FPC 43 is increased and loads to the carriage motor 15 can be reduced. Accordingly, the ink jet printer according to the embodiment of the invention can form a precise image.

While the invention has been described with reference to the embodiments, it is to be understood that the invention is not restricted to the particular forms shown in the foregoing embodiments. Various modifications and alterations can be made thereto without departing from the scope of the invention, as set forth in the appended claims.

For example, the above-described advantages may be obtained to some extent, if the tube members 31 protruding from the print head 7 is inclined even slightly toward the forward direction, where the supporting portions 51 are provided, with respect to the moving direction of the print head 7. However, the preferable inclination angles of the tube members 31 are from 15 to 45 degrees toward the forward direction with respect to the moving direction of the print head 7, and more preferably from 25 to 35 degrees. To reduce the size of the inkjet printer in the width direction of the recording sheet, the optimum inclination angle of the tube members 31 is 30 degrees toward the supporting portion 51 with respect to the moving direction of the print head 7.

The pad or sponge is attached to the tube guides 53 at a portion where a bundle of the tube members 31, the FPC 43, and the protective film 43 tied by the tube band 41 contacts. However, the pad or sponge may be attached only to a part of the tube guide 53 where the tube band 41 contacts, without attaching the pad or the sponge to the whole area of the tube guide 53 where the bundle contacts. This structure is desirable especially when a thick tube band 41 is employed and a bundle does not contact the tube guide 53 but only the tube band 41 does, due to the thickness of the tube band 41.

Instead of providing the pad or sponge, a recess maybe provided on the tube guide 53 where the tube band 41, which ties the tube members 31, the FPC 43, and the protective film 45 in a bundle, contacts. At a position where the tube band 41 is not provided, the tube members 31 do not directly contact the tube guides 53, but contacts the tube guides 53 through the FPC 43 and the protective film 45 that are disposed at a outward side of the tube members 31 with some space between the tube members 31, and the FPC 43/the protective film 45. In this case, an impact applied to the tube members 31 can be reduced by the FPC 43 and the protective film 45 serving as cushioning members and due to the space provided between the tube members 31 and the FPC 43/the protective film 45. At a position where the tube band 41 is provided, an impact caused when the tube band 41 makes contact with the tube guides 53, is applied to the tube members 31. The application of the impact to the tube members 31 may be eliminated or reduced by providing the recess on the tube guide 53.

Similar to the protective film 45, the FPC 43 is disposed with a width direction thereof being vertical to the platen 5. Therefore, the bending of the tube members 31 toward the recording sheet may be restricted by the FPC 43. If the FPC 43 has a sufficient strength and the durability, the FPC 43 may also serve as a protective film and therefore protective film 45 may be omitted.

The front face of the cover 25 may be slightly shifted forwarder than the front face of the guide rail 13. The tube members 31 are naturally deformed downwardly due to the gravity. With the structure such that the front face of the cover 25 is shifted forwarder, the downward deformation or bending of the tube members 31 can be restricted. More specifically, the cover 25 and the guide rail 13 form a plane vertical to the tube bending direction. Thus, the downward bending of the tube members 31 can be blocked or restricted by such vertical plane without the tube members 31 being raised when its bending or movement is blocked. Therefore, the tube members 31 are prevented from coming into contact with the recording sheet.

In the above-described embodiment, the cover 25 is provided so as to cover the transport roller 3 over an area printable with the print head 7. However, the cover 25 may be provided so as to cover only a part where the tube members 31 contact the transport roller 3. While the print head 7 mounted on the carriage 11 is being reciprocated, the tube members 31 contact the rear surface of the tube guide 53, sometimes across the tube guide 53, as shown by the solid lines in FIG. 3. However, the tube members 31 do not contact the transport roller 3 across the entire transport roller 3. The parts where the tube members 31 contact the transport roller 3 are limited to such an area as shown by the dotted lines in FIG. 3, and only the limited parts of the transport roller 3 may be covered by the cover 25.

The tube band 41 may be formed of, for example, relatively hard plastic material that has some elasticity, so that the stopper 60 can have greater rigidity. Accordingly, the positions of the protective film 45 and the FPC 43 relative to the tube members 31 can be properly maintained. The size of the openings 47 of the tube band 41 can be made smaller than the outer diameter of each of the tube members 31, so that the slip stopper does not have to be formed. Consequently, the productivity of the tube band 41 can be increased.

In the embodiment of the invention, the total number of the tube members 31 is four and the number of the tube members 31 in a bundle is two. However, the total number of the tube members 31 and the number of the tube members 31 in a bundle are not limited to four and two, respectively. It is preferable that the number of the tube members 31 in a bundle be an equal number, in view of making the print head 7 low-profile and making the resistance applied to the print head 7 during its movement in one scanning direction and opposite direction be substantially the same.

In the above-described embodiment, the guide rail 13 and the cover 25 are provided on the upstream side in the sheet feeding direction and the tube guides 53 are provided on the downstream side. However, structures where the upstream side and downstream side are reversed may be used. For example, the transport roller 3 may serve as a roller that discharges the recording sheet, such as the discharge roller 9, and the discharge roller 9 serves as the roller that transports or feeds the recording sheet in the sheet feeding direction, such as the transport roller 3.

What is claimed is:

1. An ink jet printer, comprising:

a print head that forms an image onto a recording medium by ejecting an ink;

an ink container that contains the ink supplied to the print head, the ink container being provided separately from the print head;

a guide rail that guides the print head in a width direction of the recording medium;

a print head moving device that reciprocates the print head along the guide rail;

a tube member that protrudes from an opening located at a first side surface or a second side surface of the print head on an end side facing a moving direction thereof and connects the print head and the ink container over a full range of a print head moving area to supply the ink from the ink container to the print head, the tube member having elasticity; and a roller that feeds the recording medium in a direction perpendicular to the guide rail, the roller being disposed near the guide rail, wherein the tube member is routed between said print head and the ink container within the print head moving area such that a bend is formed in the tube member which dynamically flexes as the print head reciprocates along the guide rail, a volume of a trajectory delineated by the dynamically flexing bend in the tube member is substantially contained within a volume of a trajectory delineated by the print head while the print head reciprocates, the roller and the guide rail are disposed along a plane substantially perpendicular to a direction that the tube member bends as the print head moves, the opening and the guide rail are disposed at approximately a same height, and a distance between the roller and the guide rail prevents the tube member from passing through the distance between the roller and the guide rail.

2. The ink jet printer according to claim 1, wherein the tube member includes a plurality of tube members and the print head includes a plurality of drive portions, each of which are connected to one of the plurality of tube members to independently supply the ink, a first tube group that has at least two of the plurality of tube members and protrudes from the first side surface of the print head, the at least two of the plurality of tube members of the first tube group are vertically arranged so as to extend substantially parallel to the recording medium, and the first tube group is provided with a coupling member that fixedly maintains a positional relationship between the tube members that are vertically arranged.

3. The ink jet printer according to claim 2, wherein the coupling member includes a tying member that fixedly ties the at least two of the plurality of tube members in a bundle, and the distance between the roller and the guide rail is set smaller than at least one of a total outer diameter dimension of the at least two of the plurality of tube members of the first tube group in a tube arrangement direction and a dimension of the tying member in the tube arrangement direction, to prevent the tube member from passing through the distance between the roller and the guide rail.

4. The ink jet printer according to claim 2, wherein the print head is capable of ejecting a plurality of colors of the ink and has the plurality of drive portions associated with the colors of the ink, and the plurality of tube members and the plurality of drive portions are connected to each other in association with the colors of ink to independently supply the colors of the ink.

5. The ink jet printer according to claim 1, further comprising a protective film that is formed into a substantially belt shape and is set with the tube member with a width direction of the protective film disposed along a perpendicular direction to the recording medium, the protective film restricting bending of the tube member in the perpendicular direction to the recording medium.

6. The ink jet printer according to claim 5, wherein the protective film is set with the tube member such that the protective film is positioned to an outward side of the tube member that is curved as the print head moves.

7. The ink jet printer according to claim 6, wherein a width of the protective film is greater the distance between the roller and the guide rail.

8. The ink jet printer according to claim 1, further comprising a flat cable that is set with the tube member with a width direction of the flat cable disposed perpendicular to the recording medium and moves together with the tube member, the flat cable applying a drive signal to the print head.

9. The ink jet printer according to claim 8, wherein the flat cable is set with the tube member such that the flat cable is positioned to an outward side of the tube member that is curved as the print head moves.

10. The ink jet printer according to claim 1, further comprising a cover that covers the roller to prevent the tube member, that bends as the print head moves, from contacting the roller, and wherein the cover and the guide rail are disposed along a plane substantially perpendicular to a direction that the tube member bends as the print head moves, and the roller cover and the guide rail are disposed with a distance therebetween that prevents the tube member from passing through the distance between the cover and the guide rail.

11. The ink jet printer according to claim 1, further comprising a supporting portion that supports the tube member connected to the ink container at a position away from the print head moving area and toward a recording medium feeding direction perpendicular to the width direction of the recording medium, wherein the tube member protrudes from the first side surface or second side surface of the print head facing the moving direction of the print head and extends to the supporting portion substantially parallel to the recording medium while curving within the print head moving area between the print head and the supporting portion.

12. An ink jet printer, comprising:

a print head that forms an image onto a recording medium by ejecting an ink;

an ink container that contains the ink supplied to the print head, the ink container provided separately from the print head;

a guide rail that guides the print head in a width direction of the recording medium;

a print head moving device that reciprocates the print head along the guide rail;

a tube member that protrudes from an opening located at a first side surface or a second side surface of the print head on an end side facing a moving direction thereof and connects the print head and the ink container over a full range of a print head moving area to supply the ink from the ink container to the print head, the tube member having elasticity;

a flat cable that is set with the tube member and moves together with the tube member, the flat cable applying a drive signal to the print head; and a roller that feeds the recording medium in a direction perpendicular to the guide rail, the roller being disposed near the guide rail, wherein the tube member is routed between said print head and the ink container within the print head moving area such that a bend is formed in the tube member which dynamically flexes as the print head reciprocates along the guide rail, a volume of a trajectory delineated by the dynamically flexing bend in the tube member is substantially contained within a volume of a trajectory delineated by the print head while the print head reciprocates, the roller and the guide rail are disposed along a plane substantially perpendicular to a direction in which the tube member bends as the print head moves, the opening and the guide rail are disposed at approximately a same height, and a distance between the roller and the guide rail prevents at least one of the tube member and the flat cable from passing through the distance between the roller and the guide rail.

13. The ink jet printer according to claim 12, further comprising a tying member that ties the tube member and the flat cable in a bundle, wherein the distance between the roller and the guide rail is shorter than a length of the tying member to prevent at least one of the tube member and the flat cable from passing through the distance between the roller and the guide rail.

14. The ink jet printer according to claim 13, wherein the tying member ties the tube member and the flat cable so as to move one of the tube member and the flat cable in a longitudinal direction thereof and so as to change one of tying positions where the tube member is tied by the tying member and where the flat cable is tied by the tying member.

15. The ink jet printer according to claim 13 further comprising a protective film that is formed into a substantially belt shape and is set with the tube member with a width direction of the protective film disposed along a perpendicular direction to the recording medium, the protective film restricting bending of the tube member in the perpendicular direction to the recording medium, the protective film protecting the flat cable by covering the flat cable from a side located opposite to the tube member.

16. The ink jet printer according to claim 15, wherein a width of the protective film is greater the distance between the roller and the guide rail.

17. The ink jet printer according to claim 15, wherein the tying member ties the tube member, the flat cable, and the protective film in a bundle, and the tying member ties the tube member, the flat cable, and the protective film so as to move one of the tube member, and the flat cable and the protective film in a longitudinal direction thereof and so as to change one of tying positions where the tube member is tied by the tying member and where the flat cable and the protective film are tied by the tying member.

18. The ink jet printer according to claim 17, wherein the protective film is wider than the flat cable and has a slit that is partially formed on the protective film so as to substantially match a width of the flat cable, and the tying member includes an opening that securely holds the tube member, and a groove that has a dimension greater than the width of the flat cable and slidably holds the flat cable and the protective film at the slit.

19. The ink jet printer according to claim 12, further comprising a supporting portion that fixedly supports the tube member at a position between the print head and the ink container and away from a substantially central portion of the print head moving area and toward a recording medium feeding direction.

20. The ink jet printer according to claim 19, further comprising a tube guide that extends from the supporting portion along the print head moving area, and wherein the tube guide, the roller, and the guide rail restrict movement of the tube member, that flexes as the print head moves, toward the recording medium feeding direction.

21. The ink jet printer according to claim 20, wherein the tube guide is provided such that a distance between the tube guide and the guide rail becomes wider from the supporting portion toward an end of the print head moving area at least at a part of the tube guide.

22. The ink jet printer according to claim 12, wherein the tube member includes a plurality of tube members and the print head includes a plurality of drive portions, each of which are connected to one of the plurality of tube members to independently supply the ink, the plurality of tube members include a first tube group that protrudes from the first side surface of the print head, a second tube group that protrudes from the second side surface of the print head, the first tube group is set with a first flat cable that applies to the drive signal to the drive portions for supplying the ink through the first tube group and the second tube group is set with a second flat cable that applies to the drive signal to the drive portions for supplying the ink through the second tube group, and the roller and the guide rail is disposed with the distance therebetween that prevents any one of the first tube group, the second tube group, the first flat cable, and the second flat cable from passing through the distance between the roller and the guide rail.

23. The ink jet printer according to claim 12, further comprising a cover that covers the roller to prevent the tube member, that bends as the print head moves, from contacting the roller, and wherein the cover and the guide rail are disposed along a plane substantially perpendicular to a direction in which the tube member bends as the print head moves, and the cover and the guide rail are disposed with a distance therebetween that prevents at least one of the tube member and the flat cable from passing through the distance between the cover and the guide rail.

24. The ink jet printer according to claim 12, further comprising a supporting portion that supports the tube member connected to the ink container at a position away from the print head moving area and toward a recording medium feeding direction perpendicular to the width direction of the recording medium, wherein the tube member protrudes from the first side surface or the second side surface of the print head facing the moving direction of the print head and extends to the supporting portion substantially parallel to the recording medium while curving within the print head moving area between the print head and the supporting portion.

25. An ink jet printer, comprising:

a print head that forms an image onto a recording medium by ejecting an ink;

an ink container that contains the ink supplied to the print head, the ink container being provided separately from the print head;

a guide rail that guides the print head in a width direction of the recording medium;

a print head moving device that reciprocates the print head along the guide rail; and a tube member that protrudes from a first side surface or a second side surface of the print head on an end side facing a moving direction thereof and connects the print head and the ink container over a full range of a print head moving area to supply the ink from the ink container to the print head, the tube member having elasticity, wherein the tube member is routed between said print head and the ink container within the print head moving area such that a bend is formed in the tube member which dynamically flexes as the print head reciprocates along the guide rail, a volume of trajectory delineated by the dynamically flexing bend in the tube member is substantially contained within a volume of a trajectory delineated by the print head while the print head reciprocates, the guide rail is disposed along a plane substantially perpendicular to a direction that the tube member bends as the print head moves, and the guide rail is disposed at a position of the plane that prevents the tube member from crossing over the guide rail.

26. An ink jet printer, comprising:

a print head that forms an image onto a recording medium by ejecting an ink;

an ink container that contains the ink supplied to the print head, the ink container being provided separately from the print head;

a guide rail that guides the print head in a width direction of the recording medium;

a print head moving device that reciprocates the print head along the guide rail;

a tube member that protrudes from a first side surface or a second side surface of the print head on an end side facing a moving direction thereof and connects the print head and the ink container over a full range of a print head moving area to supply the ink from the ink container to the print head, the tube member having elasticity;

a roller that feeds the recording medium in a direction perpendicular to the guide rail, the roller being disposed near the guide rail; and a cover that covers the roller to prevent the tube member, that bends as the print head moves, from contacting the roller;

wherein the tube member is routed between said print head and the ink container within the print head moving area such that a bend is formed in the tube member which dynamically flexes as the print head reciprocates along the guide rail, a volume of a trajectory delineated by the dynamically flexing bend in the tube member is substantially contained within a volume of a trajectory delineated by the print head while the print head reciprocates, the cover is disposed along a plane substantially perpendicular to a direction that the tube member bends as the print head moves, and the cover is disposed at a position of the plane that prevents the tube member from crossing over the cover.

* * * * *